US005788095A

United States Patent [19]

Watson

[11] Patent Number: 5,788,095

[45] Date of Patent: Aug. 4, 1998

[54] OFFSET BOOM AND MAST APPARATUS

[76] Inventor: Sammy Watson, 1604 Hwy. 91 South, Colquitt, Ga. 31737

[21] Appl. No.: 736,337

[22] Filed: Oct. 23, 1996

Related U.S. Application Data

[63] Continuation-in-part of Ser. No. 546,414, Oct. 20, 1995, abandoned.

[51] Int. Cl.[6] ..... B66C 23/36

[52] U.S. Cl. ..... 212/180; 212/252; 212/253; 414/543

[58] Field of Search ..... 212/295, 180, 212/252, 253, 901, 306; 414/543

[56] References Cited

U.S. PATENT DOCUMENTS

| | | | |
|---|---|---|---|
| 873,076 | 12/1907 | Olsen et al. | 212/253 |
| 1,026,901 | 5/1912 | Brown | 212/180 |
| 1,134,707 | 4/1915 | Stone | 212/252 |
| 2,615,584 | 10/1952 | Adams | 212/180 |
| 2,616,575 | 11/1952 | Sila | 212/180 |
| 4,050,587 | 9/1977 | Moen | 212/901 |
| 4,881,864 | 11/1989 | Amato | 212/180 |
| 5,211,297 | 5/1993 | Vandervalk | 212/901 |
| 5,431,526 | 7/1995 | Peterson et al. | 212/295 |
| 5,494,117 | 2/1996 | Aldridge | 212/253 |

*Primary Examiner*—Thomas J. Brahan

[57] ABSTRACT

A boom and mast apparatus includes a transverse support member which has a proximal portion and a distal portion. A longitudinal mast assembly is connected to the distal portion of the transverse support member. The longitudinal mast assembly includes a support-member-connected end and a boom-member-connected end. The longitudinal mast assembly also includes a lower segment connected to the transverse support member, an upper segment, and a connector assembly for selectively connecting the upper segment to the lower segment. A first bearing ring is connected transversely to a topmost portion of the lower segment. A second bearing ring is connected transversely to a bottommost portion of the upper segment. The second bearing ring is placed in registration with the first bearing ring when the boom and mast apparatus is assembled. A boom member is connected to the boom-member-connected end of the longitudinal mast assembly. A winch assembly is connected to the upper segment of the longitudinal mast assembly. A winding strap is wound by the winch assembly. A bottom portion of the lower segment of the longitudinal mast assembly is hollow and receives a support leg assembly which can selectively be retracted into or extended out from the bottom portion of the lower segment. The support leg assembly includes a leg member and a base member. The leg member includes a plurality of adjustment channels.

1 Claim, 4 Drawing Sheets

OFFSET BOOM AND MAST APPARATUS

BACKGROUND OF THE INVENTION

RELATED APPLICATION

This is a continuation-in-part application of my prior application for OFFSET BOOM AND MAST APPARATUS, Ser. No. 08/546,414, filed Oct. 20, 1995, now abandoned, which latter hereby is incorporated herein and made part of the present application by this reference.

FIELD OF THE INVENTION

The present invention relates generally to boom and mast devices and, more particularly, to one especially adapted for mounting at the rear of a pickup truck.

DESCRIPTION OF THE PRIOR ART

Boom and mast devices are well known for suspending objects from an elevated position. A use of a boom and mast device that is of special interest is for hanging a deer that is to be skinned. Throughout the years, a number of innovations have been developed relating to devices for hanging a deer to be skinned, and the following U.S. patents are representative of some of those innovations: U.S. Pat. Nos. 3,871,084; 4,903,372; 5,211,601; and 5,236,386.

More specifically, U.S. Pat. No. 3,871,084 discloses a deer skinning device by which the deer is suspended from an overhead structure, a loop is locked onto the deer's skin, and a motor vehicle is used to pull the skin off the deer. This device does not have its own boom and mast. This is a disadvantage because a suitable overhead tree limb or the like may not be readily available for suspending a deer. Moreover, with this device, good control of the skinning action may be very difficult to accomplish because the pulling force that a motor vehicle exerts may be very difficult to control. In addition, the driver of the motor vehicle cannot be next to the deer that is being skinned. This makes it difficult to monitor the skinning operation, especially when a person is acting alone without the assistance of other persons. In this respect, it would be desirable if a deer skinning device uses a boom and mast so the lack of availability of a suitable tree limb will not be a problem. Moreover, it would be desirable if a deer skinning device were provided which permits a person to be next to the deer as it is being skinned.

U.S. Pat. No. 4,903,372 discloses a portable deer pole that is attached to the rear bumper of a pickup truck. This device has a vertically extending pole that is attached to the rear bumper. As a result, the tailgate of the pickup truck cannot be lowered when this device is attached to the rear bumper. The vertically extending pole blocks the lowering of the tailgate of the truck. In this respect, it would be desirable if a deer skinning device were provided that can be attached to the rear of a pickup truck and still permits lowering of the tailgate of the truck.

U.S. Pat. No. 5,211,601 disclose a mechanical deer skinning device which employs a winch to pull a deer carcass out from the deer skin. Even though a winch is used, a deer can be quite heavy, and pulling a carcass out of its skin can require much effort. Considerably less effort is involved is the carcass is suspended, and the skin is pulled off of the carcass. A person can use his own body weight when pulling the skin off. In this respect, it would be desirable if a deer skinning device were provided which employs a winch and permits deer skin to be pulled off of a carcass.

U.S. Pat. No. 5,236,386 discloses a portable deer hoist and support which depends upon the availability of a suitable overhead tree limb or the like. No winch is provided.

Aside from the patents discussed above, the following patents disclose cranes and other lifting devices that can be moved around on wheeled vehicles: U.S. Pat. Nos. 382,307; 3,433,368; 4,150,754; and 4,881,864. More specifically, each of U.S. Pat. Nos. 382,307, 3,433,368, and 4,150,754 discloses a crane that has no swivel action between the top boom portion and the bottom boom support. However, there may be times when it would be desirable for a top boom portion to have a swivel action with respect to a bottom boom support.

U.S. Pat. No. 4,881,864 discloses a boom hoist for attachment to a trailer hitch drawbar. The top boom portion can swing around on the bottom boom support by employment of a telescopic connection between the top and bottom portions. In order to operate satisfactorily, a telescopic connection needs to have a relatively tight fit. The telescopic connection bears a substantial amount of vertically supported weight which causes wear and tear on the telescopic connection. As wear and tear occur, the telescopic connection can become loose and wobbly, which is especially undesirable for a load bearing boom. In this respect, it would be desirable if an offset boom and mast apparatus were provided which has a swivel connection between an upper boom portion and a lower boom support without using a vertically-weight-receiving, load-bearing telescopic connection between the upper boom portion and the lower boom support.

U.S. Pat. No. 4,881,864 also discloses, as do other patents discussed above, the use of a winch, two pulleys, and a cable for lifting and carrying a load. Generally, each of the two pulleys and the winch are located at one apex of a right triangle, respectively. Generally, one pulley is located at the apex of the right angle, and one pulley and the winch are located at apexes of the acute angles, respectively. The cable follows a right-angled path; that is, the cable traverses the two right-angles sides of the right triangle. To permit the use of a shorter cable, and to provide a more favorable distribution of forces in the cable, the pulleys, and the winch, it would be desirable if the winch were not in a right triangle with the two pulleys, and it would be desirable if the cable followed a path which traverses the hypotenuse of a right triangle.

In the device disclosed in U.S. Pat. No. 4,881,864, the vertical stanchion projects below the horizontally projecting tongue which projects from the stanchion to the vehicle. This is true whether an extensible support leg is extended or retracted. As a result, the device may take up needless space during storage, even when the extensible support leg is retracted. In this respect, it would be desirable if an offset boom and mast apparatus had a vertical boom support that does not project below a horizontal support member that is attached to a vehicle, even when an extensible support leg is retracted.

Still other features would be desirable in an offset boom and mast apparatus. After a deer is skinned, it is often desirable to cut the carcass into conveniently sized portions. To do so, the presence of a table would be desirable. Out in the field, tables are generally not available. However, the lowered tailgate of a pickup truck can readily serve as a table. Therefore, it would be desirable if a boom and mast device can be used that permits the tailgate of a pickup truck to be used as a table.

To be used for suspending a deer so that it can be skinned, the boom and mast device must be quite long. Storing such a long boom and mast device may pose a problem. To solve this problem, it would be desirable if a relatively long boom and mast device could be partially disassembled to provide much shorter components for convenient storage.

When a boom and mast device is disassembled for convenient storage, for even greater convenience in storage, it would be desirable if the boom and mast device were disassembled into two components that have substantially the same profile shape. When this is the case, one component can be placed on top of the other component, and the floor space or shelf space of both components is equal to that of only one component.

Another way of storing plural items in a way that is very efficient in the use of storage space is to have the plural items nested together during storage. In this respect, it would be desirable if a boom and mast device can be disassembled into two components that can be stored in a nested arrangement.

As an alternative to disassembling a relatively long boom and mast device, it would be desirable to reduce the storage size of a long boom and mast device by being able to fold one portion with respect to another portion. The folded portions can be connected by a hinge so that they are not displaced from one another.

As a matter of interest, U.S. Pat. Nos. 5,064,078 and Des. 301,127 disclose boom devices that are attached to trucks. U.S. Pat. No. 5,064,078 includes a boom and a mast but would not permit a tailgate of a pickup truck to be lowered when the boom and mast device is used. U.S. Pat. No. Des. 301,127 discloses a boom that is not attached to a mast.

Thus, while the foregoing body of prior art indicates it to be well known to use an offset boom and mast that is attached to a motor vehicle, the prior art described above does not teach or suggest an offset boom and mast apparatus which has the following combination of desirable features: (1) has a swivel action between a top boom portion and a bottom boom support; (2) has a swivel connection between an upper boom portion and a lower boom support without using a vertically-weight-receiving, load-bearing telescopic connection between the upper boom portion and the lower boom support; (3) has a winch which is not in a right triangle with two pulleys; (4) has a cable which follows a path which traverses the hypotenuse of a right triangle; and (5) has a vertical boom support that does not project below a horizontal support member that is attached to a vehicle, even when an extensible support leg is retracted. The foregoing desired characteristics are provided by the unique offset boom and mast apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a boom and mast apparatus which includes a transverse support member which has a proximal portion and a distal portion. A longitudinal mast assembly is connected to the distal portion of the transverse support member. The longitudinal mast assembly includes a support-member-connected end and a boom-member-connected end. The longitudinal mast assembly also includes a lower segment connected to the transverse support member, an upper segment, and a connector assembly for selectively connecting the upper segment to the lower segment. A first bearing ring is connected transversely to a topmost portion of the lower segment. A second bearing ring is connected transversely to a bottommost portion of the upper segment. The second bearing ring is placed in registration with the first bearing ring when the boom and mast apparatus is assembled. A boom member is connected to the boom-member-connected end of the longitudinal mast assembly. The transverse support member is oriented perpendicularly to the longitudinal mast assembly. The boom member is oriented perpendicularly to the longitudinal mast assembly. The first bearing ring, the lower segment, and the transverse support member form a support module. The second bearing ring, the upper segment, and the boom member form a boom module.

A first pair of brace members are connected between the transverse support member and the longitudinal mast assembly. A second pair of brace members are between the longitudinal mast assembly and the boom member. A winch assembly is connected to the upper segment of the longitudinal mast assembly. A first strap support is connected to a distal end portion of the boom member. A winding strap includes a strap portion wound on the winch assembly. Another strap portion extends over the first strap support, and another strap portion hangs from the first strap support. A second strap support is connected to proximal end portions of the second pair of brace members. A hook is connected to the portion of the winding strap hanging from the first strap support. The first strap support and the second strap support can be in the form of pulleys or simple pegs.

A top portion of the lower segment of the longitudinal mast assembly is hollow, and a bottom portion of the upper segment of the longitudinal mast assembly is hollow. The connector assembly used for connecting the lower segment with the upper segment includes a first tubular sleeve assembly inserted in the top hollow portion of the lower segment and a second tubular sleeve assembly inserted in the bottom hollow portion of the upper segment. The first tubular sleeve assembly and the second tubular sleeve assembly form a telescopic connection and are capable of rotating with respect to each other.

The first tubular sleeve assembly extends longitudinally and is partially outside of the lower segment, and the second tubular sleeve assembly extends longitudinally and is partially outside of the upper segment. The first tubular sleeve assembly includes a first non-round sleeve end which prevents rotation of the first tubular sleeve assembly within the lower segment which is also no-round, and the second tubular sleeve assembly includes a second non-round sleeve end which prevents rotation of the second tubular sleeve assembly within the upper segment which is also non-round.

A bottom portion of the lower segment of the longitudinal mast assembly is hollow and receives a support leg assembly which can selectively be retracted into or extended out from the bottom portion of the lower segment. The support leg assembly includes a leg member and a base member. The leg member includes a plurality of adjustment channels.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved offset boom and mast apparatus which has all of the advantages of the prior art and none of the disadvantages.

It is another object of the present invention to provide a new and improved offset boom and mast apparatus which may be easily and efficiently manufactured and marketed.

It is a further object of the present invention to provide a new and improved offset boom and mast apparatus which is of durable and reliable construction.

An even further object of the present invention is to provide a new and improved offset boom and mast apparatus which is susceptible of a low cost of manufacture with regard to both materials and labor, and which accordingly is then susceptible of low prices of sale to the consuming public, thereby making such offset boom and mast apparatus available to the buying public.

Still yet a further object of the present invention is to provide a new and improved offset boom and mast apparatus which uses a boom and mast so that the lack of availability of a suitable tree limb will not be a problem.

Still another object of the present invention is to provide a new and improved offset boom and mast apparatus that permits a person to be next to a deer as it is being skinned.

Yet another object of the present invention is to provide a new and improved offset boom and mast apparatus which can be attached to the rear of a pickup truck and still permit lowering of the tailgate of the truck.

Even another object of the present invention is to provide a new and improved offset boom and mast apparatus that employs a winch and permits deer skin to be pulled off of a suspended carcass.

Still a further object of the present invention is to provide a new and improved offset boom and mast apparatus which permits the tailgate of a pickup truck to be used as a table.

Yet another object of the present invention is to provide a new and improved offset boom and mast apparatus that can be partially disassembled to provide much shorter components for convenient storage.

Still another object of the present invention is to provide a new and improved offset boom and mast apparatus which can be disassembled into two components that have substantially the same profile shape.

Yet another object of the present invention is to provide a new and improved offset boom and mast apparatus that can be disassembled into two components that can be stored in a nested arrangement.

Still yet a further object of the present invention is to provide a new and improved offset boom and mast apparatus which has a swivel action between a top boom portion and a bottom boom support.

Still another object of the present invention is to provide a new and improved offset boom and mast apparatus that has a swivel connection between an upper boom portion and a lower boom support without using a vertically-weight-receiving, load-bearing telescopic connection between the upper boom portion and the lower boom support.

Yet another object of the present invention is to provide a new and improved offset boom and mast apparatus which has a winch which is not in a right triangle with two pulleys.

Even another object of the present invention is to provide a new and improved offset boom and mast apparatus that has a cable which follows a path which traverses the hypotenuse of a right triangle.

Still a further object of the present invention is to provide a new and improved offset boom and mast apparatus which has a vertical boom support that does not project below a horizontal support member that is attached to a vehicle, even when an extensible support leg is retracted.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
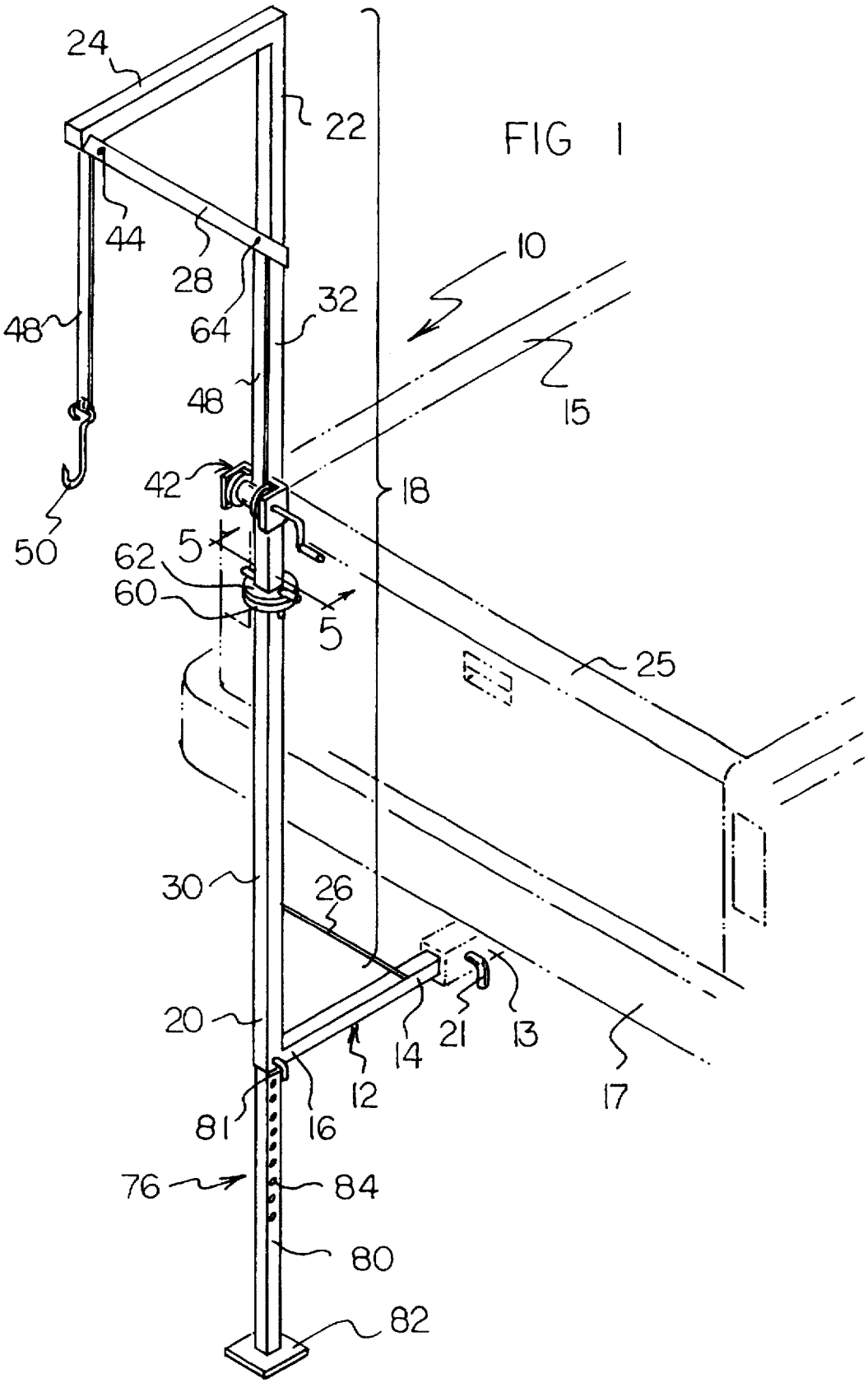
FIG. 1 is a perspective view showing a preferred embodiment of the offset boom and mast apparatus of the invention attached to the rear of a pickup truck.

With reference to the drawings, a new and improved offset boom and mast apparatus embodying the principles and concepts of the present invention will be described.

Turning to FIGS. 1–6, there is shown an exemplary embodiment of the offset boom and mast apparatus of the invention generally designated by reference numeral 10. In its preferred form, offset boom and mast apparatus 10 includes a transverse support member 12 which has a proximal portion 14 and a distal portion 16. A longitudinal mast assembly 18 is connected to the distal portion 16 of the transverse support member 12. The longitudinal mast assembly 18 includes a support-member-connected end 20 and a boom-member-connected end 22. The longitudinal mast assembly 18 also includes a lower segment 30 connected to the transverse support member 12, an upper segment 32, and a connector assembly for selectively connecting the upper segment 32 to the lower segment 30. A first bearing ring 60 is connected transversely to a topmost portion of the lower segment 30. A second bearing ring 62 is connected transversely to a bottommost portion of the upper segment 32. The second bearing ring 62 is placed in registration with the first bearing ring 60 when the boom and mast apparatus 10 is assembled. A boom member 24 is connected to the boom-member-connected end 22 of the longitudinal mast assembly 18. The transverse support member 12 is oriented perpendicularly to the longitudinal mast assembly 18. The boom member 24 is oriented perpendicularly to the longitudinal mast assembly 18. The first bearing ring 60, the lower segment 30, and the transverse support member 12 form a support module. The second bearing ring 62, the upper segment 32, and the boom member 24 form a boom module.

A first pair of brace members 26 are connected between the transverse support member 12 and the longitudinal mast assembly 18. A second pair of brace members 28 are between the longitudinal mast assembly 18 and the boom member 24. A winch assembly 42 is connected to the upper segment 32 of the longitudinal mast assembly 18. A first strap support 44 is connected to a distal end portion of the boom member 24. A winding strap 48 includes a strap portion wound on the winch assembly 42. Another strap portion extends over the first strap support 44, and another strap portion hangs from the first strap support 44. A second strap support 64 is connected to proximal end portions 66 of the second pair of brace members 28. A hook 50 is connected to the portion of the winding strap 48 hanging from the first strap support 44. The first strap support 44 and the second strap support 64 can be in the form of pulleys or simple pegs.

A top portion of the lower segment 30 of the longitudinal mast assembly 18 is hollow, and a bottom portion of the upper segment 32 of the longitudinal mast assembly 18 is hollow. The connector assembly used for connecting the lower segment 30 with the upper segment 32 includes a first tubular sleeve assembly 68 inserted in the top hollow portion of the lower segment 30 and a second tubular sleeve assembly 70 inserted in the bottom hollow portion of the upper segment 32. The first tubular sleeve assembly 68 and the second tubular sleeve assembly 70 form a telescopic connection and are capable of rotating with respect to each other.

The first tubular sleeve assembly 68 extends longitudinally and is partially outside of the lower segment 30, and the second tubular sleeve assembly 70 extends longitudinally and is partially outside of the upper segment 32. The first tubular sleeve assembly 68 includes a first non-round sleeve end 72 which prevents rotation of the first tubular sleeve assembly 68 within the lower segment 30 which is also non-round, and the second tubular sleeve assembly 70 includes a second non-round sleeve end 74 which prevents rotation of the second tubular sleeve assembly 70 within the upper segment 32 which is also non-round.

Figure 5:
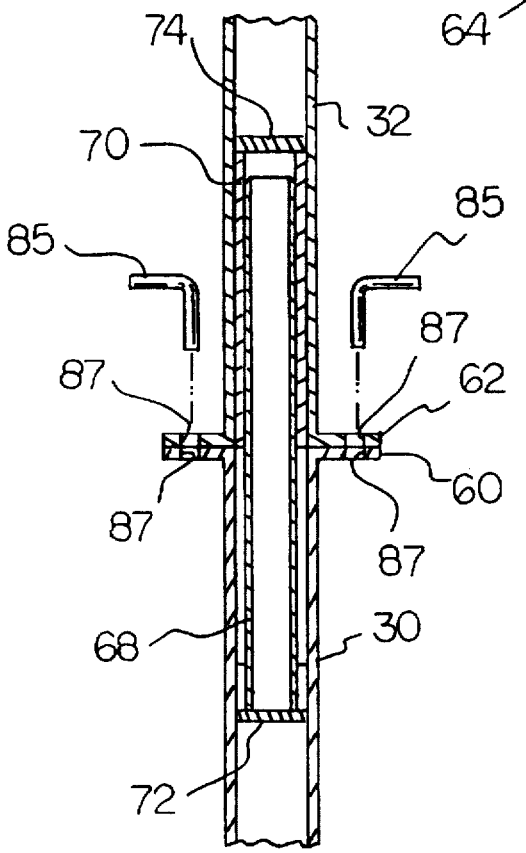
FIG. 5 is an enlarged partial cross-sectional and partially exploded view of the embodiment of the invention shown in FIG. 1 taken along line 5—5 thereof.
Figure 6:
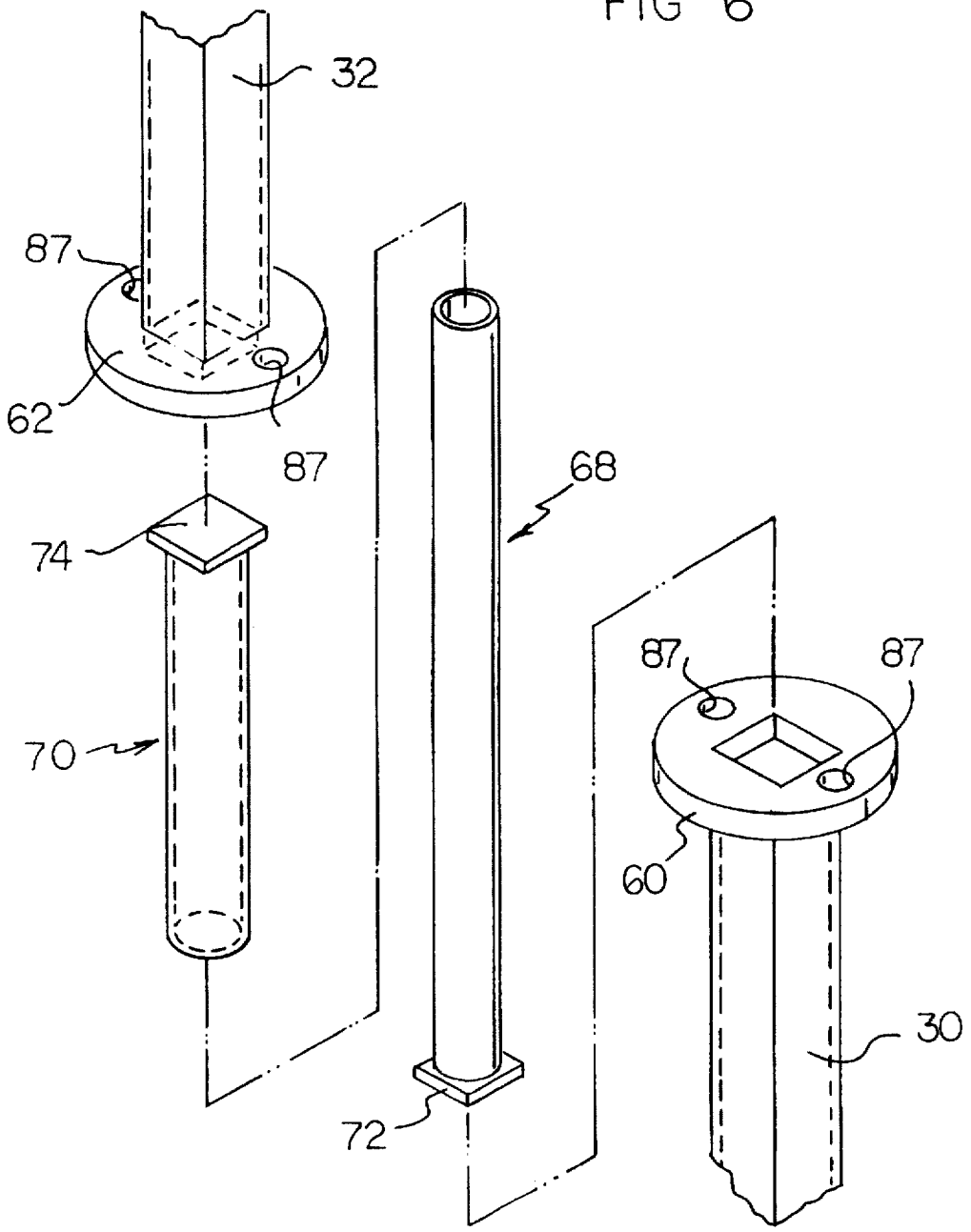
FIG. 6 is an enlarged exploded perspective view of the portion of the invention shown in FIG. 5.

As shown in FIGS. 5 and 6, an exterior surface of the second tubular sleeve 70 is positioned in tangential contact with four orthogonally oriented interior walls of the bottom hollow portion of the upper segment 32 and in tangential contact with four orthogonally oriented interior walls of the top hollow portion of the lower segment 30. The first tubular sleeve assembly 68 preferably extends longitudinally beyond the top hollow portion of the lower segment 30 and into the second tubular sleeve assembly 70. This structure results in the second tubular sleeve assembly 70 residing both between the first tubular sleeve assembly 68 and the bottom hollow portion of the upper segment 32 and between the first tubular sleeve assembly 68 and the upper hollow portion of the lower segment 30. As also shown in FIG. 5, the first tubular sleeve assembly 68 preferably does not move relative to the second tubular sleeve assembly and both of the tubular sleeves do not move relative to the upper and lower segments 30 and 32 when the bearing rings 60 and 62 are positioned in abutting contact with each other so as to maintain a longitudinal positioning of the first tubular sleeve assembly relative to the second tubular sleeve assembly.

A bottom portion of the lower segment 30 of the longitudinal mast assembly 18 is hollow and receives a support leg assembly 76 which can selectively be retracted into or extended out from the bottom portion of the lower segment 30. The support leg assembly 76 includes a leg member 80 and a base member 82. The leg member 80 includes a plurality of adjustment channels 84. The bottom of the lower segment 30 of the longitudinal mast assembly 18 has a lock channel. When the lock channel and a selected adjustment channel 84 are placed in registration, a portion of an L-shaped locking arm 81 can be inserted through the lock channel and into the selected adjustment channel 84 to lock the support leg assembly 76 in a desired extended position with respect to the lower segment 30. Preferably, the position of extension is provided so that the support leg assembly 76 supports a substantial amount of weight supported by the hook 50, thereby relieving tension off of the transverse support member 12 and the support bracket 13 of the pickup truck 15.

In using the embodiment of the invention shown in the drawings, the proximal portion 14 of the transverse support member 12 is inserted into a support bracket 13 which is attached to the rear of a pickup truck 15 below the bumper 17. The support bracket 13 is in the form of a metal tube which receives the proximal portion 14 of the transverse support member 12. A screw lock 21 is provided for securing the connection of the transverse support member 12 to the support bracket 13. Moreover, a lock aperture is provided in the proximal portion 14 of the transverse support member 12 for receiving an end portion of the screw lock 21 to further secure the transverse support member 12 to the support bracket 13 and, thusly, to the pickup truck 15.

Figure 2:
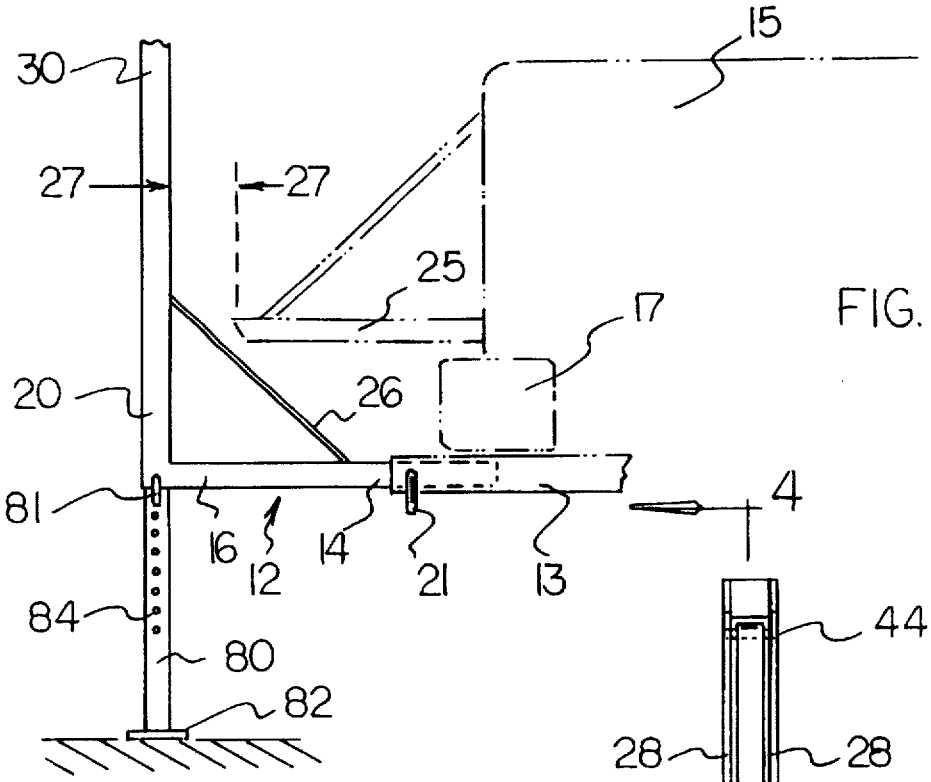
FIG. 2 is a side view of a bottom portion of the embodiment of the offset boom and mast apparatus shown in FIG. 1.
Figure 3:
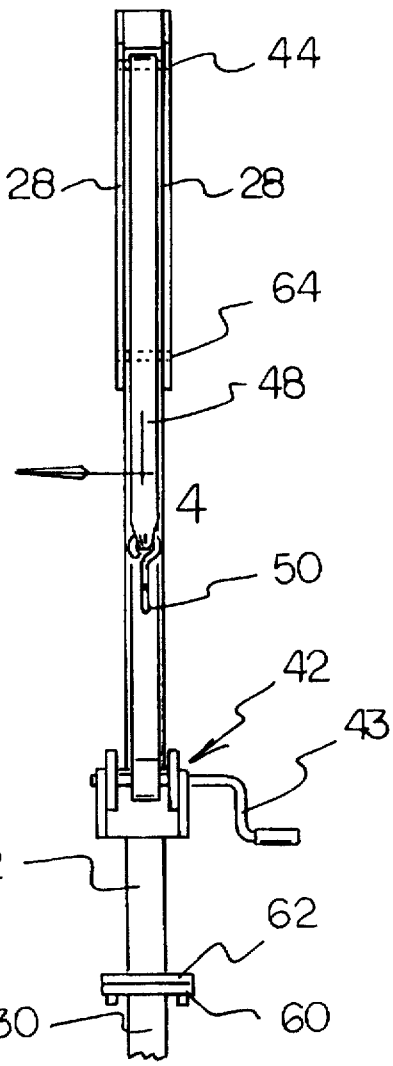
FIG. 3 is an enlarged front view of a top portion of the embodiment of the offset boom and mast apparatus of FIG. 1.
Figure 4:
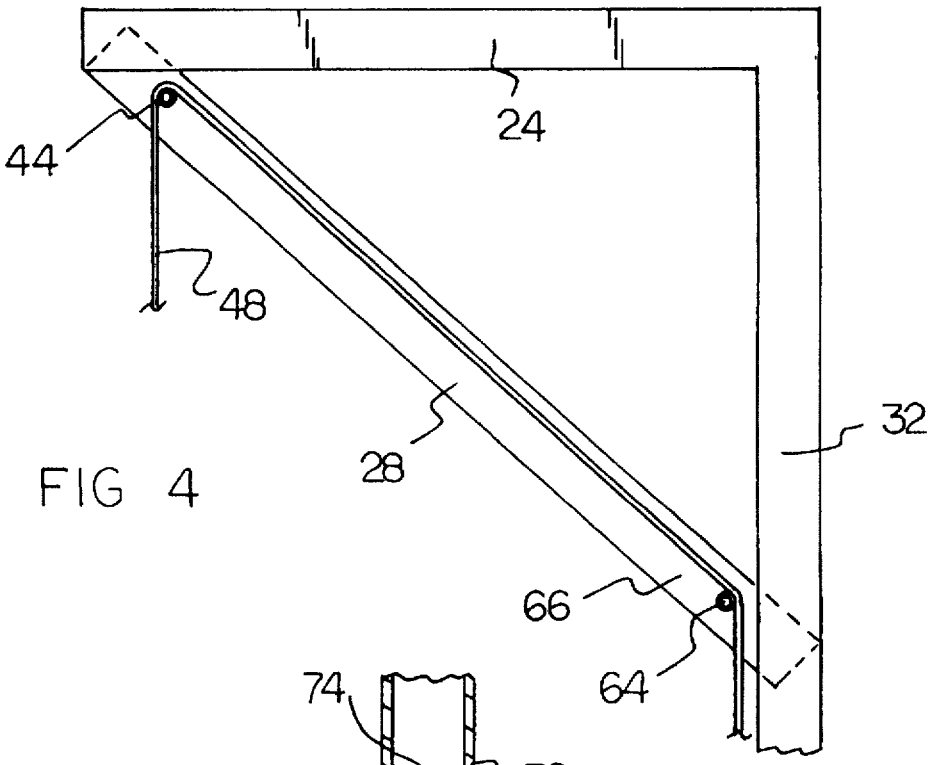
FIG. 4 is an enlarged side view of the top portion of the embodiment of the invention shown in FIG. 3 taken along line 4—4 thereof.

The length of the transverse support member 12 is selected so that it is sufficiently long to provide a clearance 27 between the longitudinal mast assembly 18 and the tailgate 25 of the pickup truck 15 when the tailgate 25 is in a lowered position, as shown in FIG. 2.

To connect the boom module to the support module, the first non-round sleeve end 72 of the first tubular sleeve assembly 68 is lowered into the top hollow portion of the lower segment 30 of the longitudinal mast assembly 18 through an opening in the first bearing ring 60, leaving a portion of the first tubular sleeve assembly 68 projecting upward from the lower segment 30. The second non-round sleeve end 74 of the second tubular sleeve assembly 70 is inserted up into the bottom hollow portion of the upper segment 32 through an opening in the second bearing ring 62, leaving a portion of the second tubular sleeve assembly 70 projecting downward from the upper segment 32. Then, the downwardly projecting portion of the second tubular sleeve assembly 70 is placed over the upwardly projecting portion of the first tubular sleeve assembly 68 so that the second tubular sleeve assembly 70 and the first tubular sleeve assembly 68 are connected telescopically with each other. The upper segment 32 is lowered sufficiently so that the second bearing ring 62 rests upon the first bearing ring 60. When assembled thusly, the first bearing ring 60 and the second bearing ring 62 provide vertical load-bearing support, relieving the first tubular sleeve assembly 68 and the second tubular sleeve assembly 70 from enduring substantial vertical load-bearing forces. Moreover, the top surface of the first bearing ring 60 and the bottom surface of the second bearing ring 62 provide slippage surfaces when the boom member 24 is rotated around the longitudinal mast assembly 18 with respect to the transverse support member 12.

The winding strap 48 is threaded from the winch assembly 42, over the second strap support 64 and over the first strap support 44. Hook 50 is connected to the portion of the winding strap 48 hanging from the first strap support 44.

Once a specific angle of rotation or swinging of the boom member 24 with respect to the transverse support member 12 is selected, or if it is desired to prevent further rotation or swinging of the boom member 24 with respect to the transverse support member 12, the first bearing ring 60 and the second bearing ring 62 can be fixed with respect to each other by the use of L-shaped lock bars 85. Free ends of the lock bars 85 can be passed through lock channels 87 that are present in the first bearing ring 60 and the second bearing ring 62 and that are placed in registration with each other.

Once the boom module and the support module are connected together, a deer carcass (not shown) can be hung from the hook 50 and winding strap 48. The winch assembly 42 can be operated by handle 43 to raise or lower the winding strap 48 and hook 50 and the deer carcass thereon. Once the deer carcass has been skinned, or at any time, the boom and mast apparatus 10 of the invention permits the lowered tailgate 25 to be used as a table. The lowered tailgate 25 can be used for cutting the skinned deer into smaller portions.

To store the invention, the locking arm 81 is removed from the lower segment 30 and the leg member 80, and the support leg assembly 76 can be removed from the lower segment 30. To remove the boom and mast apparatus 10 from the pickup truck 15, screw lock 21 is turned to disengage the lock aperture of the transverse support member 12. The transverse support member 12 can then be pulled out of the lock aperture. The boom module is pulled off of the support module. Then, for storage purposes the boom member 24 can be placed along side the transverse support member 12, and, at the same time, the upper segment 32 of the longitudinal mast assembly 18 can be placed along side the lower segment 30. This storage arrangement of the boom module and the support module is highly conservative of storage space.

The components of the offset boom and mast apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved offset boom and mast apparatus that is low in cost, relatively simple in design and operation, and which may advantageously be used having a swivel action between a top boom portion and a bottom boom support. With the invention, an offset boom and mast apparatus is provided which has a swivel connection between an upper boom portion and a lower boom support without using a vertically-weight-receiving, load-bearing telescopic connection between the upper boom portion and the lower boom support. With the invention, an offset boom and mast apparatus is provided which has a winch which is not in a right triangle with two pulleys. With the invention, an offset boom and mast apparatus is provided which has a cable which follows a path which traverses the hypotenuse of a right triangle. With the invention, an offset boom and mast apparatus is provided which has a vertical boom support that does not project below a horizontal support member that is attached to a vehicle, even when an extensible support leg is retracted.

In addition, with the invention, the lack of availability of a suitable tree limb for suspending a deer carcass will not be a problem. With the invention, an offset boom and mast apparatus is provided which permits a person to be next to a deer as it is being skinned. With the invention, an offset boom and mast apparatus is provided which can be attached to the rear of a pickup truck and still permit lowering of the tailgate of the truck. With the invention, an offset boom and mast apparatus is provided which employs a winch and permits deer skin to be pulled off of a suspended carcass. With the invention, an offset boom and mast apparatus is provided which permits the tailgate of a pickup truck to be used as a table. With the invention, an offset boom and mast apparatus is provided which can be partially disassembled to provide much shorter components for convenient storage. With the invention, an offset boom and mast apparatus is provided which can be disassembled into two components that have substantially the same profile shape. With the invention, an offset boom and mast apparatus is provided which can be disassembled into two components that can be stored in a nested arrangement. With the invention, an offset boom and mast apparatus is provided which can be reduced in length for storage by folding one portion with respect to another portion.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A boom and mast apparatus comprising:

a transverse support member having a proximal portion and a distal portion;

a longitudinal mast assembly connected to the distal portion of the transverse support member, the longitudinal mast assembly including a support-member-connected end and a boom-member-connected end, wherein the longitudinal mast assembly includes a lower segment connected to the transverse support member, an upper segment, and a connector assembly for selectively connecting the upper segment to the lower segment;

a boom member connected to the boom-member-connected end of the longitudinal mast assembly;

a pair of brace members, the brace members having distal end portions and proximal end portions, the distal end portions connected to the boom member, the proximal end portions connected to the upper segment of the longitudinal mast assembly;

a winch assembly connected to the upper segment of the longitudinal mast assembly, a first strap support connected to the distal end portions of the brace members, a winding strap which includes a strap portion wound on the winch assembly, a strap portion extending over the first strap support, a strap portion hanging from the first strap support, a second strap support connected to the proximal end portions of the pair of brace members, and a hook connected to the portion of the winding strap hanging from the first strap support;

wherein a bottom portion of the lower segment of the longitudinal mast assembly is hollow and receives a support leg assembly which can selectively be retracted into or extended out from the bottom portion of the lower segment;

a first bearing ring connected transversely to a topmost portion of the lower segment, and a second bearing ring connected transversely to a bottommost portion of the upper segment, the bearing rings extending radially outwardly from the respective segment and including lock channels extending therethrough;

wherein a top portion of the lower segment of the longitudinal mast assembly is hollow, and a bottom portion of the upper segment of the longitudinal mast assembly is hollow, and further wherein the lower segment and the upper segment are both substantially rectangular in cross section such that the top hollow portion of the lower segment includes four orthogonally oriented interior walls and the bottom hollow portion of the upper segment includes four orthogonally oriented interior walls;

wherein the connector assembly for connecting the lower segment with the upper segment includes a first tubular sleeve assembly removably inserted in the top hollow portion of the lower segment, with a first non-round sleeve end secured to the first tubular sleeve assembly which prevents rotation of the first tubular sleeve assembly within the lower segment;

wherein the connector assembly further includes a second tubular sleeve assembly removably inserted in the bottom hollow portion of the upper segment such that an exterior surface of the second tubular sleeve is positioned in tangential contact with the four orthogonally oriented interior walls of the bottom hollow portion of the upper segment, and a second non-round sleeve end secured to the second tubular sleeve assembly which prevents rotation of the second tubular sleeve assembly within the upper segment;

wherein the first tubular sleeve assembly and the second tubular sleeve assembly form an interlocking connection and are capable of rotating with respect to each other;

wherein the second tubular sleeve assembly extends longitudinally beyond the bottom hollow portion of the upper segment and into the top hollow portion of the lower segment such that an exterior surface of the second tubular sleeve is positioned in tangential contact with the four orthogonally oriented interior walls of the top hollow portion of the lower segment, and the first tubular sleeve assembly extends longitudinally beyond the top hollow portion of the lower segment and into the second tubular sleeve assembly, whereby the second tubular sleeve assembly resides between the first tubular sleeve assembly and the bottom hollow portion of the upper segment and between the first tubular sleeve assembly and the top hollow portion of the lower segment, the connector assembly operating to position the second bearing ring in registration with the first bearing ring;

wherein the first tubular sleeve assembly does not move relative to the second tubular sleeve assembly and both of the tubular sleeves do not move relative to the upper and lower segments when the bearing rings are positioned in abutting contact with each other so as to maintain a longitudinal positioning of the first tubular sleeve assembly relative to the second tubular sleeve assembly and the upper and lower segments;

a lock bar extending through the lock channels in the bearing rings so as to selectively prevent rotation of the bearing rings relative to one another.

* * * * *